United States Patent [19]

Clark

[11] Patent Number: 4,527,599

[45] Date of Patent: Jul. 9, 1985

[54] WIRE TWISTER

[75] Inventor: Albert L. Clark, West Bend, Wis.

[73] Assignee: John F. Langkau, Cleveland, Ohio ; a part interest

[21] Appl. No.: 568,047

[22] Filed: Jan. 4, 1984

[51] Int. Cl.[3] ..... B21F 7/00

[52] U.S. Cl. ..... 140/119; 74/89.21

[58] Field of Search ..... 140/119, 120, 93.6; 74/89.2, 89.21

[56] References Cited

U.S. PATENT DOCUMENTS

| | | | |
|---|---|---|---|
| 549,494 | 11/1895 | Coram | 140/120 |
| 1,488,980 | 4/1924 | Fodrea | 140/120 |
| 1,714,387 | 5/1929 | Martinet | 140/119 |
| 1,822,833 | 9/1931 | Wilking | 140/119 |
| 3,169,559 | 2/1965 | Working, Jr. | 140/119 |
| 3,590,391 | 7/1971 | Winegar | 140/119 |
| 3,859,862 | 1/1975 | Brems | 74/89.21 |

FOREIGN PATENT DOCUMENTS

| | | | |
|---|---|---|---|
| 331139 | 6/1930 | United Kingdom | 140/119 |

*Primary Examiner*—Lowell A. Larson
*Assistant Examiner*—Linda McLaughlin
*Attorney, Agent, or Firm*—Fuller, House & Hohenfeldt, S.C.

[57] ABSTRACT

A power driven wire twister is suitable for twisting relatively heavy multi-strand wires. The strands are twisted by means of a chain and sprocket drive. The wire twister housing and output sprocket are suitably slotted to allow placement of the wire at the axis of rotation of the twisting sprocket. A tooth carried by the output sprocket separates the strands of the wire into two approximately equal groups prior to twisting. A large angle of contact between the chain and slotted output sprocket insures that a sufficient number of sprocket teeth are always in mesh with the chain for heavy duty continuous operation.

8 Claims, 4 Drawing Figures

WIRE TWISTER

BACKGROUND OF THE INVENTION

1. Field of the Invention

This invention pertains to wire tensioning apparatus and more particularly to apparatus for twisting multiple strand wires to produce longitudinal tension therein.

2. Description of the Prior Art

A conventional method of securing heavy loads to trucks and other vehicles is to tension chains, straps, or other hold-down devices. A preferred hold-down arrangement includes a metal wire composed of several strands that are twisted about each other to produce the desired longitudinal tension in the wire. The twisted wire technique has not been utilized to the maximum extent because of a lack of suitable wire twisting devices. U.S. Pat. No. 549,494 shows a simple hand twisting tool. Although the tool of the U.S. Pat. No. 549,494 possesses the advantage of light weight and portability, it is evident that the tool is limited to twisting relatively light wires, and that the amount of wire longitudinal tension is limited by the strength of the workmen using it. U.S. Pat. No. 3,590,391 discloses a three-handled hand twister that opens and closes to engage and disengage the wire. The manipulation of the twisting device of the U.S. Pat. No. 3,590,391 is cumbersome. The device is further handicapped because the wire tension obtainable is dependent on the strength of the workmen. U.S. Pat. No. 3,169,559 illustrates a portable power operated tool that ties the ends of U-shaped wires by twisting. It is evident that the tension produced in a tied wire is minimal and that the tool of the U.S. Pat. No. 3,169,559 is not suitable for securing heavy loads to vehicles.

U.S. Pat. No. 1,488,980 teaches a non-portable wire working machine that may be either hand or power operated. The machine operates on a fixed cycle that limits the amount of twist imparted to the wire strands. Increased twisting is possible by rotating the twisting mechanisms through increased angles during each cycle. However, the increased angle of twist necessarily limits the amount of torque available for twisting. Further, the amount of twist is fixed for each cycle, and thus wire tension cannot be controlled to suit the application at hand. The use of the wire twisting pin as a drive member further limits the torque transmitting capacity. It is apparent that the machine of U.S. Pat. No. 1,488,980 is suitable only for light wires, and for applications wherein an uncontrolled amount of twist is satisfactory.

Thus, a need exists for heavy duty but portable apparatus that is capable of twisting wire strands with controlled force sufficient to secure heavy objects to desired locations.

SUMMARY OF THE INVENTION

In accordance with the present invention, a power driven wire twister is provided which is capable of producing a controlled tension in a multi-strand hold-down wire. This is accomplished by apparatus that includes a chain and sprocket mechanism to drive the twisting member.

In the preferred embodiment, the wire twister is motor driven so that the tension on the hold-down wire is not limited by the strength of the user. To enhance the convenience and usefulness of the wire twister, it is designed for easy portability. Further, the wire twister has no external moving parts, thus assuring the safety of the workmen.

The wire twister comprises a housing to which may be mounted an electric torque motor. The housing further seves as a frame for mounting a train of chain driven sprockets. A projecting tooth, which is anchored to the output sprocket, is utilized to separate the wire strands into two approximately equal groups for twisting about each other. The housing and output sprocket are slotted so as to slip over the wire, and the output sprocket mounting shaft is hollow to allow the wire to approximately coincide with the axis of the output sprocket during twisting.

To produce maximum torque for twisting the strands, the output sprocket has a larger diameter than the input sprocket. The preferred construction further employs a pair of idler sprockets that engage the chain to mesh with a maximum number of output sprocket teeth.

To use the wire twister of the present invention, the worker loads the truck or other vehicle as desired, and ties the ends of a suitable multi-strand wire to hold-down eyes on the truck bed in a well known manner. The worker energizes the wire twister motor so that the output sprocket slot is aligned with the housing slot. He then places the wire twister fully over the wire so that the projecting tooth divides the strands into two approximately equal portions. Upon energizing the electric motor again, the projecting tooth is rotated by the output sprocket to twist the groups of wire strands about each other. The motor may be operated for any length of time, thereby allowing the worker to control the wire tension to the desired amount. When the wire is properly tensioned, the output sprocket slot is again aligned with the housing slot, and the wire twister is pulled off of the twisted wire.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
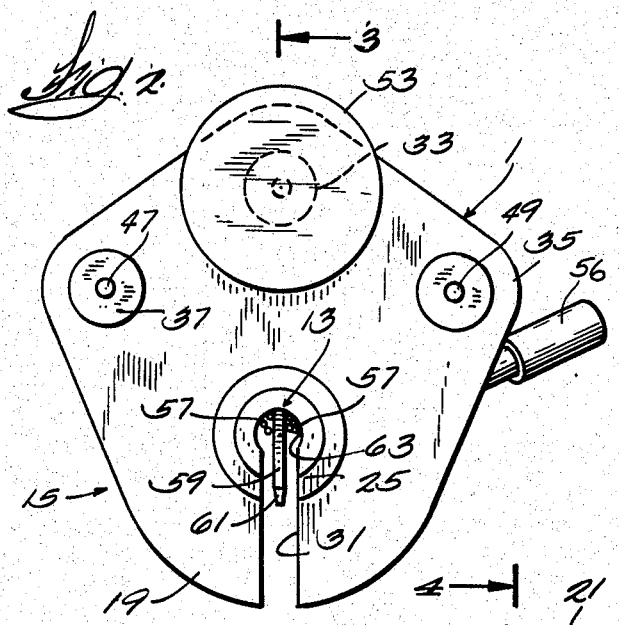
FIG. 2 is an end view of the wire twister of the present invention.
Figure 1:
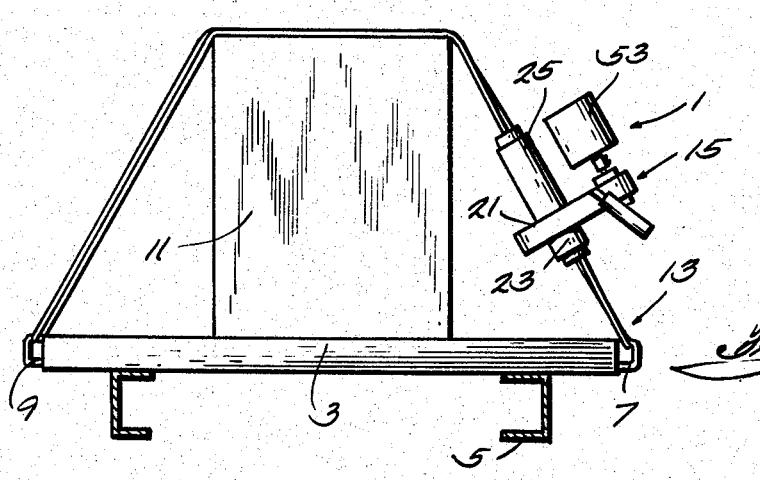
FIG. 1 is a simplified end view of a truck bed with a load secured thereto by a multi-strand wire tightened by the wire twister of the present invention.

Referring to FIGS. 1 and 2, a wire twister 1 is illustrated that includes the present invention. The wire twister finds particular usefulness for tensioning multi-strand wires to secure a load to a truck or other vehicle. However, it will be understood that the invention is not limited to cargo hauling applications.

In FIG. 1, reference numeral 3 indicates a conventional platform of a truck trailer or other vehicle mounted to the chassis 5. The platform is provided with well known hold-down devices, such as eyes 7 and 9. A typical load 11 is secured to the platform by a multi-strand wire 13 fastened to the eyes 7 and 9. To tighten the wire for safely securing the load to the truck, the strands of the wire are twisted about each other in a controlled fashion by the wire twister of the present invention.

Figure 4:
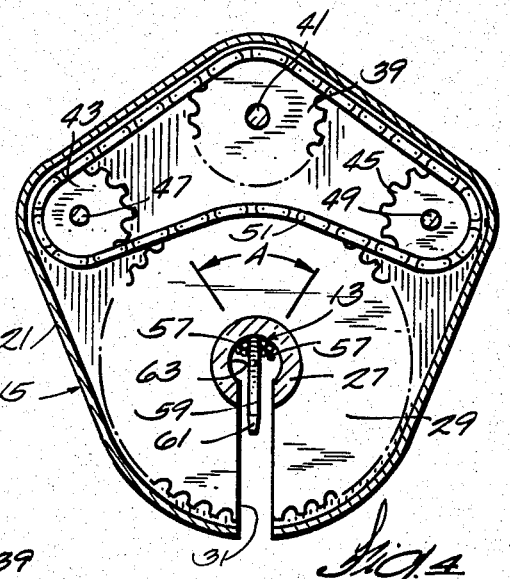
FIG. 4 is a sectional view taken along lines 4—4 of FIG. 3.
Figure 3:
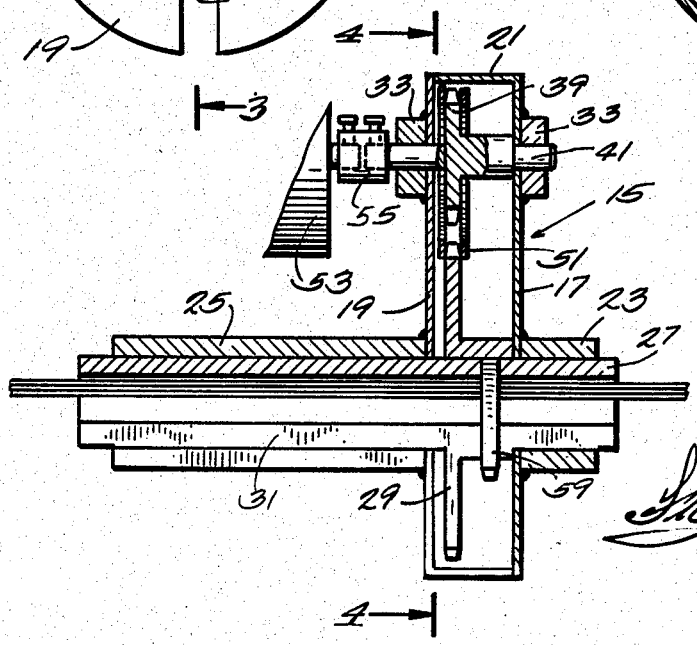
FIG. 3 is a sectional view taken along lines 3—3 of FIG. 2.

Referring to FIGS. 2–4, the wire twister 1 includes a housing 15 which preferably is constructed with a pair of generally acorn shaped end walls 17 and 19. The end walls are spaced apart by and are joined to a peripheral wall 21. Attached to the end walls 17 and 19, as by welding, are a pair of oppositely extending journals 23 and 25, respectively. As shown in FIG. 3, journal 25 may be longer than journal 23. Mounted for rotation in the journals 23 and 25 is a hollow shaft 27. An output sprocket 29 is fixedly attached to the shaft by any suitable means, such as a key or set screw, not illustrated. As best illustrated in FIGS. 2 and 4, the end walls, peripheral wall, journals, sprocket 29, and shaft 27 are all constructed with slots which, when aligned as illustrated at 31, provide radial access to the hollow center of shaft 27.

Also mounted to the housing 5 are three sets of journals 33, 35, and 37, FIGS. 2 and 3. In the illustrated embodiment, each journal consists of a pair of blocks, one block welded to each wall 17 and 19. Mounted for rotation within each journal is a sprocket carrying shaft. In FIG. 3, an input sprocket 39 is mounted by conventional means, not illustrated, to an input shaft 41. In a similar manner, idler sprockets 43 and 45 are mounted to shafts 47 and 49, respectively, FIG. 4. A chain 51 is trained around the sprockets 39, 43, 45, and 29. To provide maximum torque for twisting the wire 13, it is preferable that the idler and input sprockets be smaller in diameter than the output sprocket 29. It is further preferred that the idler sprocket axes be located equidistant from the output sprocket axis and positioned on opposite sides of a line connecting the input and output sprockets such that the chain 51 meshes with the output sprocket through an angle of contact of at least about 70°, as depicted by angle A.

To operate the wire twister of the present invention, the input shaft 41 is connected to a source of rotary power. In the preferred construction, the power source is an electric torque motor 53 mounted to the housing 15. For clarity, the mounting connection between the motor frame and housing is omitted in FIG. 3. The connection between the motor shaft and input shaft 41 may be any suitable means such as a coupling and set screws 55. To facilitate handling and operating the wire twister, a handle 56 is attached to and extends obliquely from the housing 15.

The wire 13 is composed of several strands 57. For example, the wire may have seven strands, as shown in FIGS. 2 and 4. To separate the strands into two approximately equal groups and to impart the twisting motion to the strands, an elongated projecting tooth 59 is fixedly inserted into the hollow shaft 27, FIG. 3. The outer end of the projecting tooth is fabricated with a tapered portion 61, and it extends radially into the slot 31 formed in the shaft and output sprocket 29.

To use the wire twister of the present invention for securing the load illustrated in FIG. 1, the user first energizes the motor 53 to rotate the output sprocket 29 until the slot therein is aligned with the slot in the housing 15. The motor may be controlled by any well known means, such as a switch mounted to the motor or handle 56. The user then places the slot 31 over the wire 13 so that the projecting tooth 59 divides the wire strands 57 into two approximately equal groups. The wire twister is brought into complete engagement with the wire such that the wire contacts the inner surface 63 of shaft 27 adjacent the projecting tooth, FIGS. 2 and 4. The worker next energizes the motor on a continuous basis, thereby rotating the shaft and projecting tooth to twist the two groups of strands about each other. The increase in torque produced by the relatively large output sprocket enables heavy stranded wire to be twisted, thus providing a safe cargo securing arrangement. Further, the large angle of contact A of the chain 51 with the output sprocket insures that a sufficient number of sprocket teeth mesh with the chain when the sprocket slot is within the angle of contact A. When the strands 57 have been twisted to produce the desired tension in the wire for securing the load to the platform, the user de-energizes the motor when the slot 31 of the output sprocket and housing are in alignment. He then pulls the wire twister 1 off the wire, and it is ready for use on other hold-down wires.

Thus, it is apparent that there has been produced in accordance with the invention, a wire twister that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. Portable apparatus for twisting the strands of a multi-strand wire comprising:

(a) housing means;

(b) output sprocket means mounted for continuous rotation within the housing means;

(c) input sprocket means mounted to the housing means for rotation within the housing means;

(d) a chain trained around the input and output sprocket means for transmitting power from the input sprocket means to the output sprocket means; and (e) a projecting tooth fixedly attached to the output sprocket means and adapted to engage and separate the strands of the wire into two groups, so that rotating the input sprocket means produces continuous rotation of the projecting tooth to twist the two groups of strands about each other, and wherein the housing means includes power means mounted thereto and adapted for continuously rotating the input sprocket means.

2. The apparatus of claim 1 wherein the power means is an electric motor mounted to the housing.

3. The apparatus of claim 1 wherein the housing means includes a pair of oppositely extending radially slotted journals for rotatably mounting the output sprocket means.

4. The apparatus of claim 1 wherein:

(a) the output sprocket means includes a tubular shaft having an annular wall and a sprocket mounted to the tubular shaft, the shaft having a radial slot through the annular wall and the sprocket being formed with a radial slot therein aligned with the slot in the shaft to provide wire access to the interior of the shaft; and (b) the projecting tooth is fixedly attached to the shaft and annular wall and extends into the shaft and sprocket slot.

5. The apparatus of claim 4 wherein the input sprocket means includes an input sprocket and a pair of idler sprockets having fixed axes of rotation relative to the housing means.

6. The apparatus of claim 1 wherein the housing means includes handle means fastened to the housing means and extending obliquely therefrom for facilitating handling and operation.

7. In combination with a multi-stranded wire for securing a load to a platform, portable apparatus for producing a controlled tension in the wire comprising:

(a) a housing having a slot therein;

(b) output sprocket means mounted for continuous rotation within the housing and including a sprocket having a radial slot therein alignable with the housing slot and extending from the sprocket periphery to the axis of rotation of the output sprocket means;

(c) input sprocket means mounted to the housing for rotation therein;

(d) a motor mounted to the housing and adapted to rotate the input sprocket means;

(e) a chain trained around the input sprocket means and output sprocket; and (f) a projecting tooth fixed to the output sprocket means and extending into the slot in the sprocket to engage and separate the wire strands into two approximately equal groups; and (g) handle means extending obliquely from the housing for facilitating handling and operating the wire tensioning apparatus, so that energizing the motor produces continuous rotation of the projecting tooth to twist the two groups of strands about each other to controllably produce tension in the wire for securing the load to the platform.

8. The apparatus of claim 7 wherein the input sprocket means includes an input sprocket and a pair of idler sprockets having fixed axes of rotation relative to the housing.

* * * * *